US011641705B2

(12) United States Patent
Boucher et al.

(10) Patent No.: US 11,641,705 B2
(45) Date of Patent: May 2, 2023

(54) FLAMELESS CANDLE WITH PHOTODETECTOR

(71) Applicant: Sterno Home Inc., Vancouver (CA)

(72) Inventors: Frederic Boucher, Quebec (CA); Dario Sena, Longueuil (CA); Shauna Wenzel, Holland Landing (CA)

(73) Assignee: Sterno Home Inc., Vancouver (CA)

( * ) Notice: Subject to any disclaimer, the term of this patent is extended or adjusted under 35 U.S.C. 154(b) by 0 days.

(21) Appl. No.: 17/171,633

(22) Filed: Feb. 9, 2021

(65) Prior Publication Data

US 2022/0256672 A1 Aug. 11, 2022

(51) Int. Cl.
*H05B 47/11* (2020.01)
*F21S 10/04* (2006.01)
(Continued)

(52) U.S. Cl.
CPC ..... *H05B 47/11* (2020.01); *F21S 6/001* (2013.01); *F21S 10/043* (2013.01); *H05B 45/10* (2020.01); *H05B 47/16* (2020.01); *F21Y 2115/10* (2016.08)

(58) Field of Classification Search
CPC .... F21S 9/02; F21S 6/001; F21S 10/04; F21S 13/12; F21S 9/037; F21S 10/046; F21S 19/00; F21S 8/08; F21S 10/002; F21S 10/043; F21S 13/00; F21S 9/03; F21W 2121/00; F21W 2131/10; F21W 2131/109; F21V 23/0442; F21V 35/00; F21V 33/0056; F21V 14/06; F21V 21/0824; F21V 23/0435; F21V 37/00; F21V 11/18; F21V 23/003; F21V 23/04; F21V 23/045; F21V 23/0457; F21V 23/0464; F21V 33/0028;
(Continued)

(56) References Cited

U.S. PATENT DOCUMENTS 2,443,508 A * 6/1948 Landmeier ..... G04C 23/10 74/100.1
3,483,430 A * 12/1969 Osteen ..... H05B 47/11 315/159
(Continued)

OTHER PUBLICATIONS

PCT, Notification of Transmittal of the International Search Report and the Written Opinion of the International Searching Authority, or the Declaration in International application No. PCT/IB2022/050122, dated May 9, 2022 (8 pages).

*Primary Examiner* — Monica C King
(74) *Attorney, Agent, or Firm* — McAndrews, Held & Malloy, Ltd.

(57) ABSTRACT

A flameless candle, includes: a body; a light source; a photodetector; and circuitry. The body has a shell surrounding an interior region. The light source emits light that emulates a candle flame. The circuitry detects the voltage across the photodetector and also detects the state of a user input. In response, the circuitry selectively controls the light source by turning it ON or OFF. While the light source is OFF, the circuitry compares the voltage of the photodetector to a first threshold, and when the voltage transitions to less than the first threshold, the circuitry turns the light source ON. While the light source is ON, the circuitry compares the voltage of the photodetector to a second threshold, and when the voltage is greater than the second threshold, the circuitry turns the light source OFF. The first threshold is less than the second threshold.

19 Claims, 6 Drawing Sheets

(51) Int. Cl.

| | |
|---|---|
| ***F21S 6/00*** | (2006.01) |
| ***H05B 45/10*** | (2020.01) |
| ***H05B 47/16*** | (2020.01) |
| ***F21Y 115/10*** | (2016.01) |

(58) Field of Classification Search
CPC ..... F21V 33/0052; F21V 35/003; F23D 3/24; F23D 2900/31001; F23D 3/16; F23D 3/26; H05B 45/10; H05B 45/18; H05B 45/20; H05B 47/16; H05B 47/18
See application file for complete search history.

(56) References Cited

U.S. PATENT DOCUMENTS 5,057,005 A * 10/1991 Kwok ..... F21S 13/00 84/2
6,491,516 B1 * 12/2002 Tai ..... A47G 33/00 446/175
6,733,279 B2 * 5/2004 Thigpen ..... F21S 13/12 431/298
6,981,786 B2 * 1/2006 Yao ..... F21S 6/001 362/276
7,098,600 B2 * 8/2006 Li ..... F21V 23/0442 341/150
7,277,822 B2 * 10/2007 Blemel ..... G01M 5/0091 324/543
7,699,603 B2 * 4/2010 Furner ..... F23D 3/24 431/291
10,024,507 B2 * 7/2018 Fournier ..... F21S 6/001
10,352,517 B2 * 7/2019 Carpintero ..... F21V 14/06
10,816,152 B2 * 10/2020 Boucher ..... F21S 10/002
10,823,350 B1 * 11/2020 Richmond ..... F21S 9/037
10,948,145 B2 * 3/2021 Hurduc ..... F21S 10/046
2002/0146656 A1 * 10/2002 Thigpen ..... F21V 37/00 431/298
2004/0233681 A1 * 11/2004 Yao ..... F21S 9/02 362/565
2005/0248952 A1 * 11/2005 Yao ..... F21V 23/0442 362/276
2007/0292812 A1 * 12/2007 Furner ..... F23D 3/26 431/289
2010/0007280 A1 1/2010 Liao
2011/0227510 A1 * 9/2011 Elberbaum ..... G08C 23/06 315/363
2011/0279034 A1 * 11/2011 Lucas ..... F21V 23/0464 362/249.02
2011/0311925 A1 * 12/2011 Chen ..... F21S 13/12 431/291
2012/0183280 A1 * 7/2012 Kowalec ..... A61L 9/03 392/386
2013/0170184 A1 7/2013 Browder
2014/0218901 A1 * 8/2014 Richmond ..... G10K 1/07 362/183
2014/0233141 A1 * 8/2014 Blemel ..... H02H 1/0023 361/78
2015/0362141 A1 * 12/2015 Chen ..... F21S 9/02 362/183
2016/0126733 A1 * 5/2016 Hick ..... H05B 47/11 700/295
2016/0161071 A1 * 6/2016 Jean ..... F21S 6/001 362/183
2017/0127491 A1 * 5/2017 Pope ..... H05B 45/12
2018/0220506 A1 * 8/2018 Sadwick ..... H05B 47/18
2018/0306424 A1 10/2018 Van De Sluis
2020/0154721 A1 * 5/2020 Piccionelli ..... A23G 3/563
2020/0404763 A1 * 12/2020 Reed ..... G01J 1/4204

* cited by examiner

FLAMELESS CANDLE WITH PHOTODETECTOR

CROSS REFERENCE TO RELATED APPLICATIONS

[Not Applicable]

BACKGROUND

Generally, techniques described herein relate to flameless candles. These techniques include the implementation of algorithms in which an electronic light source of a flameless candle automatically turns ON or OFF based on the amount of detected ambient light (i.e., light not generated by the candle).

SUMMARY

According to embodiments disclosed herein, a flameless candle, includes: a body; a light source; a photodetector; and circuitry. The body has a shell (such as a sidewall and an upper surface). The shell surrounds an interior region. The light source emits light (e.g., flickering light) in order to emulate a candle flame to an observer. The light source can be positioned in or above the interior region. The photodetector, such as a photoresistor or photodiode, is arranged in circuitry such that a voltage is generated across the photodetector. The photodetector can be positioned in the interior region and can detect light transmitted through the body. The circuitry detects the voltage and also detects the state of one or more user inputs (e.g., a switch or remote control signal with ON, OFF, or dusk-based mode states). Based on the detected voltage and user input state, the circuitry selectively controls the light source, for example, by turning the light source ON or OFF as viewed by the observer. While the light source is OFF, the circuitry compares the voltage of the photodetector to a first threshold, and when the voltage transitions to less than the first threshold, the circuitry turns the light source ON. While the light source is ON, the circuitry compares the voltage of the photodetector to a second threshold, and when the voltage is greater than the second threshold, the circuitry turns the light source OFF. The first threshold is less than the second threshold.

To set the different thresholds, the circuitry can automatically reconfigure between a first electrical configuration when the light source is OFF (thereby setting the first threshold) and a second electrical configuration when the light source is ON (thereby setting the second threshold). The reconfigured circuitry can include a voltage divider that includes the photodetector. The configuration of the voltage divider in the first electrical configuration can be different than the configuration of the voltage divider in the second electrical configuration.

The circuitry can include a processor that has a first pin and a second pin. The first pin can be configured as a digital input that is in electrical communication with the voltage divider, such that the first pin can detect the voltage across the photodetector. The second pin can be configured as an input in the first configuration and configured as an output in the second configuration. When the second pin is configured as an input, a resistor is removed from the voltage divider. When the second pin is configured as an output, the resistor is added to the voltage divider.

The circuitry can apply a low voltage to the light source when the light source is emitting light, and while the voltage is low, detect the voltage across the photodetector. After detecting the voltage across the photodetector, the circuitry can then apply a high voltage to the light source. The circuitry can include a timer that causes the light source to turn OFF after a predetermined period of time after the light source turns ON.

According to embodiments disclosed herein, a flameless candle, includes: a body; a light source; a photodetector; and circuitry. The body has a shell (such as a sidewall and an upper surface). The shell surrounds an interior region. The light source emits light (e.g., flickering light) in order to emulate a candle flame to an observer. The light source can be positioned in or above the interior region. The photodetector, such as a photoresistor or photodiode, is arranged in circuitry such that a voltage is generated across the photodetector. The photodetector can be positioned in the interior region and can detect light transmitted through the body. The circuitry detects the voltage and also detects the state of one or more user inputs (e.g., a switch or remote control signal with ON, OFF, or dusk-based mode states). Based on the detected voltage and user input state, the circuitry selectively controls the light source, for example, by turning the light source ON or OFF as viewed by the observer. While the light source is OFF, the circuitry compares the voltage of the photodetector to a threshold, and when the voltage transitions to less than the threshold, the circuitry turns the light source ON. After the light source is turned ON, the circuitry causes the light source to turn OFF after a predetermined period of time.

The circuitry can apply a low voltage to the light source when the light source is emitting light, and while the voltage is low, detect the voltage across the photodetector. After detecting the voltage across the photodetector, the circuitry can then apply a high voltage to the light source. The circuitry can include a timer that causes the light source to turn OFF after a predetermined period of time.

The circuitry can have a processor with a digital input. The voltage across the photodetector can be electrically communicated to the digital input.

Figure 2:
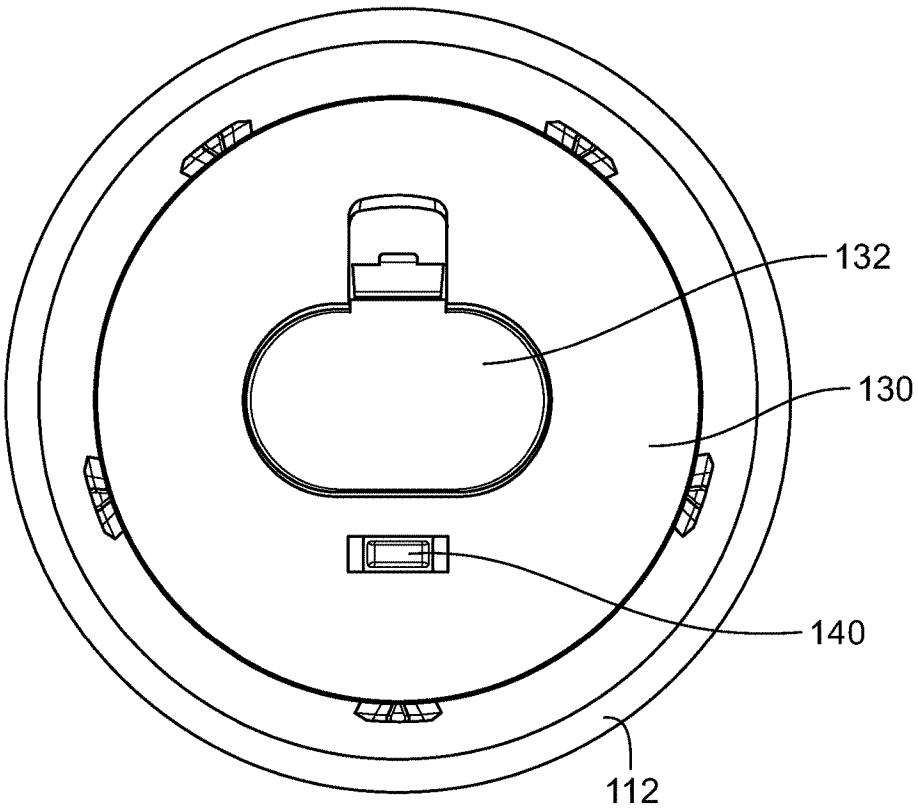
FIG. 2 illustrates a bottom view of a flameless candle, according to embodiments disclosed herein.

The foregoing summary, as well as the following detailed description of certain techniques of the present application, will be better understood when read in conjunction with the appended drawings. For the purposes of illustration, certain techniques are shown in the drawings. It should be understood, however, that the claims are not limited to the arrangements and instrumentality shown in the attached drawings. Furthermore, the appearance shown in the drawings is one of many ornamental appearances that can be employed to achieve the stated functions of the system.

DETAILED DESCRIPTION

Flameless candles provide illumination for decorative purposes. The effect of flameless candles is most pronounced when ambient light is relatively low. Accordingly, their decorative effect is less effective in high light conditions. By running a candle's light source in high light conditions, battery power is consumed while exhibiting a less effective illusion of a true candle. One way to increase battery life is to operate the candle only during periods when the illusion is more effective. Techniques disclosed herein describe candle designs that conveniently turn the light source ON when the ambient light is sufficiently low (e.g., at "dusk"). The light source can later be turned OFF when the ambient light is sufficiently high (e.g., at "dawn") or after a predetermined period of time after the light source turns ON. Such designs are simple for a user to operate, as much of the functionality is automatic and repeating. Certain techniques disclose the use of different ambient light thresholds when turning the light source ON or OFF. The threshold for dusk can be lower than the threshold for dawn. The use of different thresholds can prevent rapid switching.

Figure 1:
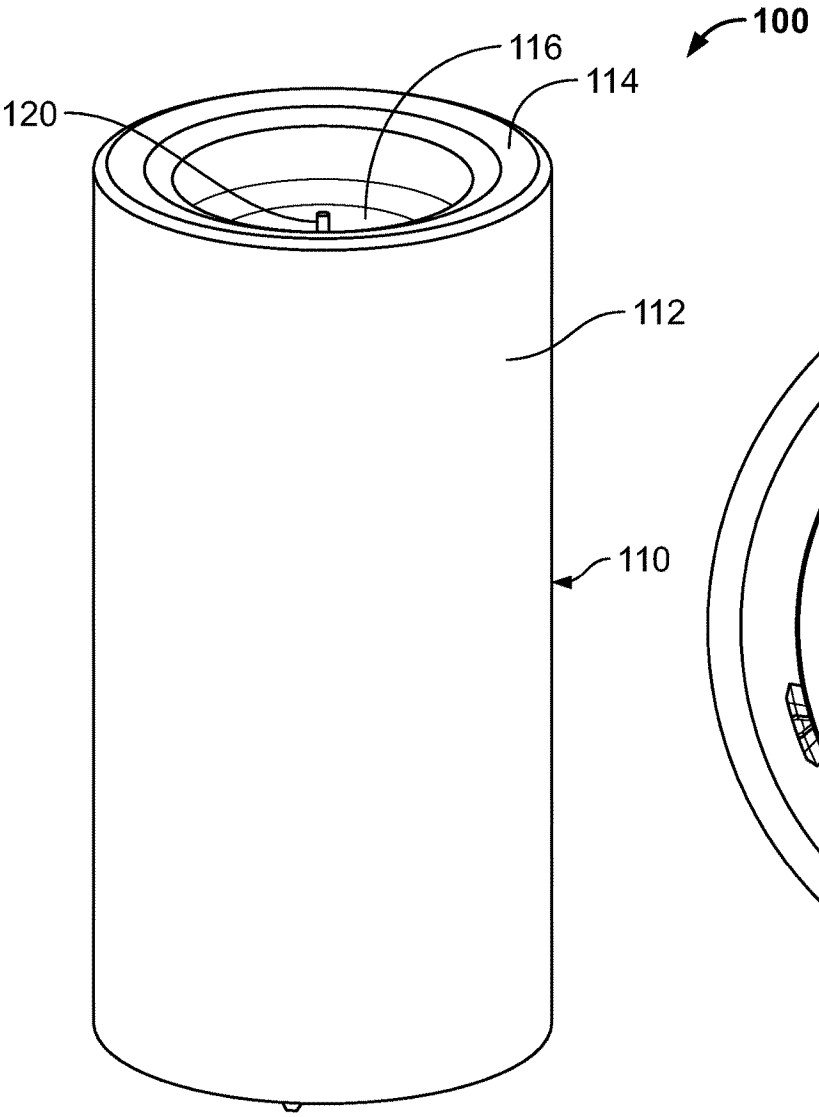
FIG. 1 illustrates a perspective view of a flameless candle, according to embodiments disclosed herein.

FIG. 1 illustrates a flameless candle 100, including a shell 110, which surrounds an interior region (not depicted). The interior region can be or can include a hollow region in which various components are located. The candle 100 is depicted as a pillar candle, but any suitable form is within the scope of the techniques described herein, including taper candles, votive candles, tea lights, irregularly-shaped candles, and the like. As shown, the shell 110 includes a sidewall 112, a rim 114, and an upper surface 116. The sidewall 112 extends upwardly and terminates at the rim 114. The upper surface 116 extends inwardly from the rim 114. The upper surface 116 can form a recess to create the impression of a conventional candle that has been used. Some or all of the portions of the shell 110 can include a material such as plastic and/or wax. An imitation wick 120 can extend upwardly from the upper surface 116 to further provide the illusion of a true candle.

The shell 110 can be translucent or include translucent regions, such that some external light can pass through the shell 110 into the interior region. The shell 110 may include a material such as translucent plastic and/or paraffin wax (e.g., a translucent plastic material coated with paraffin wax). The shell 110 can have a light transmittance between 10%-70%, for example. The shell 110 can have an aperture, for example in the upper surface 116, through which external light can pass into the interior region. As will be discussed further, certain operations of the candle 100 are in response to the amount of light detected by a photodetector. In some embodiments, the photodetector can be located in the interior region of the candle 100. In such a configuration, the photodetector detects some of the light that originates outside of the candle 100 and enters the interior region due to the transmittance of the shell 110.

FIG. 2 illustrates a bottom view of the flameless candle 100. As shown, the sidewall 112 extends to a lower surface of the candle 100. A base 130 is located within the sidewall. The base 130 can be a portion of a candle core, such as the one depicted in FIG. 3. The base 130 can include a battery door 132, which is removable to insert batteries into the candle 100. A user interface 140 can allow a user to interact with the candle 100. As shown, the user interface 140 includes an actuator for a push-button switch. A user can press the button to activate one or more modes of the candle 100. As will be explained, such modes can include ON, OFF, dusk-to-dawn, and dusk-plus-timer. The user interface 140 can include other types of inputs, such as a slide-switch actuator or touch-based sensors to sense the touch of a user's finger. The user interface 140 can also include outputs such as light-emitting elements (e.g., one or more LED) to indicate the current status or mode of the candle 100.

Figure 3:
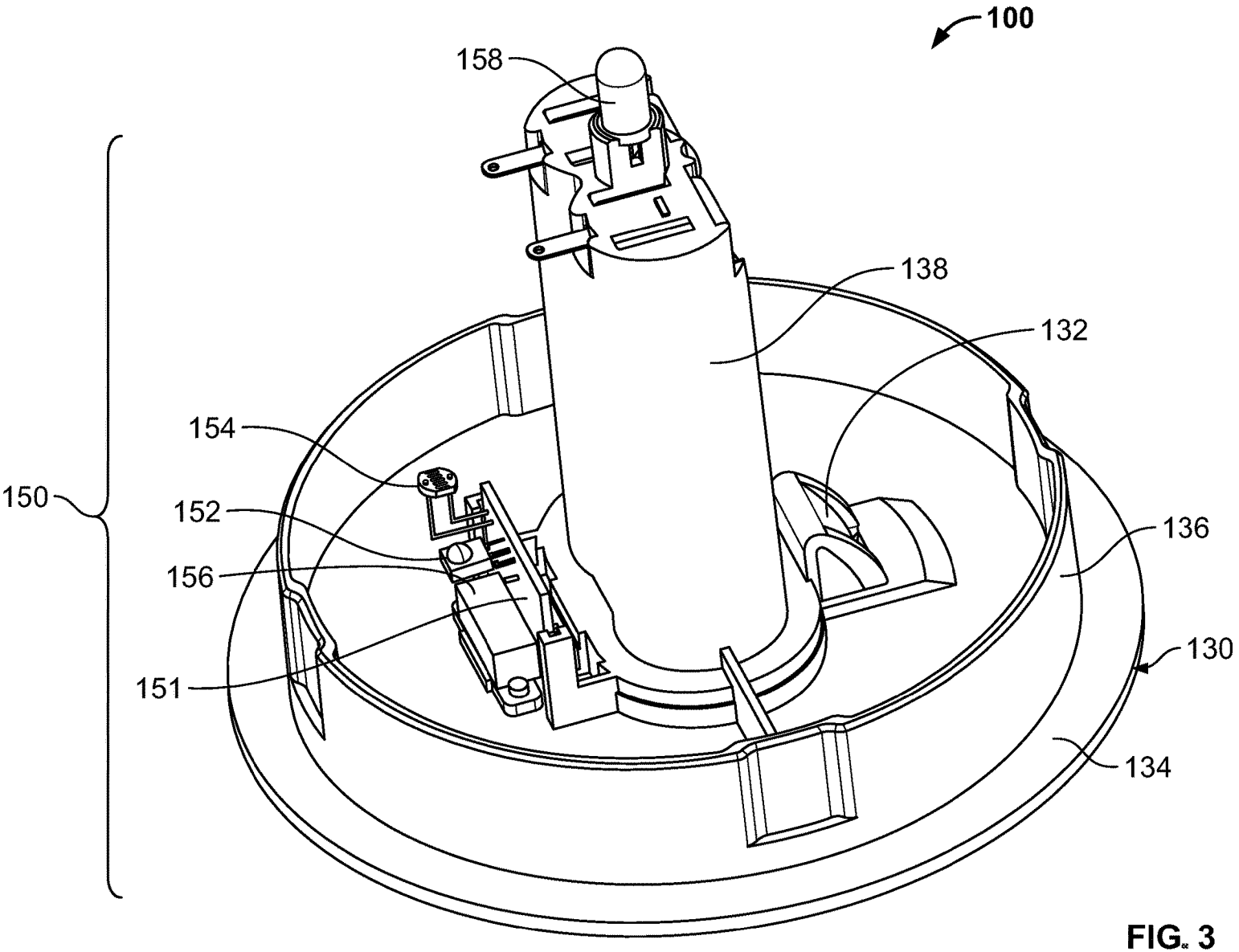
FIG. 3 illustrates a perspective view of components located in the interior region of flameless candle, according to embodiments disclosed herein.

FIG. 3 illustrates a perspective view of components located in the interior region of the flameless candle 100. As shown, these components include the base 130 and circuitry 150.

The base 130 (or a portion thereof) can extend upwardly into the interior region. The base 130 can include a flange 134 extending from a ring 136. The ring 136 can assist in guiding the shell 110 into the proper location during assembly. The ring 136 can also provide long-term stability to maintain the position of the shell 110 in the candle. An adhesive (or other means, such as friction) can be used to secure the shell 110 and the base 130. A portion of the battery door 132 can extend into the interior region. A battery housing 138 can house one or more batteries (two AA or AAA batteries, as shown) after they have been inserted into the candle 100.

Circuitry 150 can also be located in the interior region. Some or all of the circuitry 150 can be mounted or supported by the base 130. The circuitry 150 can include a circuit board 151, a wireless receiver 152, a photodetector 154, a switch 156, and a light source 158. Circuitry 150 receives power from a power source, such as batteries or an external power source (not shown). Circuitry 150 can be distributed or positioned in various locations of the candle 100. The wireless receiver 152, such as an infrared receiver that receives signals from a remote control (not shown), can be located in a suitable position where interference is reduced. The photodetector 154 can be positioned above the battery housing with the face of the photodetector 154 facing upwardly.

Portions of circuitry 150 can be located outside of or flush with the shell 110. For example, the light source 158 can be located above the upper surface 116. The photodetector 154 can be located such that its face is flush with or protrudes from the outer surface of the shell 110, and such an arrangement could increase the amount of incident light. The photodetector 154 can also be embedded within the shell 110. Some or all of the switch 156 can be located below or within the base 130.

Figure 4:
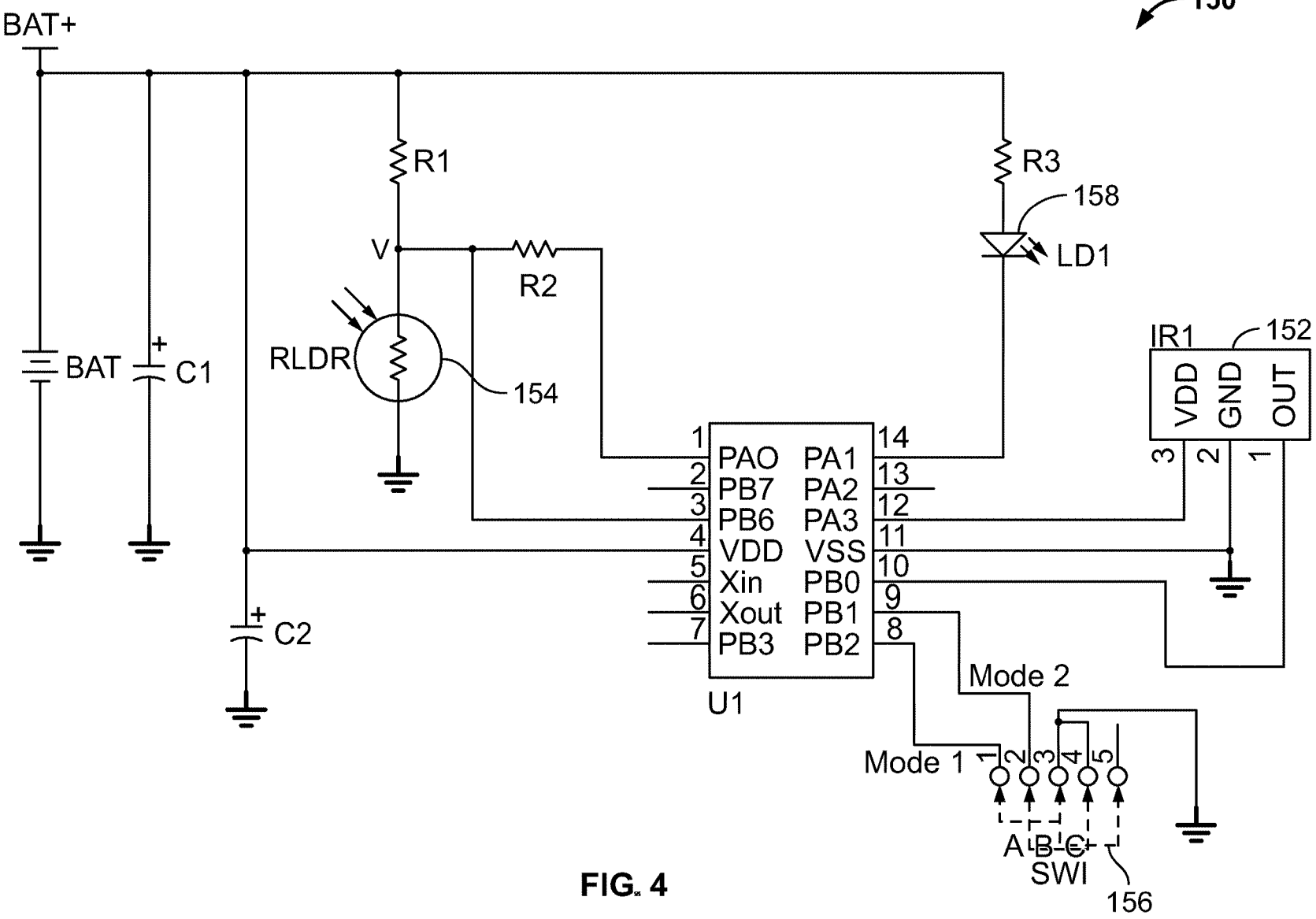
FIG. 4 illustrates circuitry in a flameless candle, according to embodiments disclosed herein.

FIG. 4 illustrates a schematic for exemplary circuitry 150. As shown, a battery BAT (which can include one or more batteries) is connected to a power bus BAT+. When BAT is two 1.5V cells in series, the voltage at BAT+ is 3V. The power source connected to the power bus BAT+ could be a different type of power source, such as a DC supply. A capacitor C1 (e.g., 100 μF) filters BAT+. The bus BAT+ provides the power supply voltage to various portions of circuitry 150, including VDD of microcontroller U1, a dynamically-reconfigurable voltage divider (R1, R2, and RLDR), and a light-source circuitry (R3 and LD1).

Microcontroller U1 may include an 8-bit processor and non-volatile memory that stores a set of commands executable by the processor to perform the functions discussed herein. One suitable microcontroller U1 is NY8A053D. Microcontroller U1 includes input/output pins, at least some of which are tri-state pins capable of being configured in a high-impedance state (input), a logic-high voltage output (current source), and a logic-low voltage output (current sink). As shown, PA1 controls the light source LD1 by toggling between the input state (or logic-high output state) and logic-low output state. When PA1 is an input or a logic-high output, current cannot flow through the light source LD1 and current-limiting resistor R3. When PA1 is a logic-low output, current flows through LD1, thereby causing light to be emitted. PA1 may be rapidly switched (for example, using pulse-width modulation) to vary the apparent intensity of light emitted from LD1. The sequence of switching can cause LD1 to "flicker" to emulate a real candle flame. Alternatively, circuitry outside of U1 can cause flickering of LD1. Such circuitry can be embedded in the package that contains LD1.

As shown, microcontroller pin PA3 is configured as a logic-high output to provide power when needed to IR1 (152), which is an infrared receiver that receives infrared signals from a remote control. One such suitable part is HL-838-H. Other types of wireless technologies, such as Bluetooth® or WiFi are suitable alternatives to infrared. IR1 (152) receives an infrared signal from the remote control (not depicted) and outputs a corresponding electrical signal at pin 1. This signal is received by U1 at PB0, which is configured as an input. The signal may serially encode data, such that the data stream communicates the different possible candle states to U1 described herein.

As depicted, pins PB1 and PB2 are configured as inputs that detect different states of switch SW1 (156). A three-position slide switch allows for multiple configurations. One configuration could be Off/On/Dusk-Plus-Timer, whereas another configuration could be Off/On/Dusk-to-Dawn, or a mix of both. PB1 is depicted as configured to detect whether SW1 (156) is in a first position (corresponding to Mode 1) or a second position (corresponding to Mode 2). When SW1 (156) connects PB1 to ground, U1 recognizes that Mode 2 has been activated. When SW1 (156) connects PB2 to ground, U1 recognizes that Mode 1 has been activated. If neither PB1 nor PB2 are connected to ground (i.e., no low input is detected), then U1 recognizes that candle 100 has been turned OFF. Note, when candle 100 is OFF, as depicted, power is still supplied to U1 and circuitry 150 continues to operate as needed. U1 can go into a sleep mode and periodically wake up, or U1 may continue to operate as normal or go into another type of low-power mode. While SW1 (156) is shown as having three states, it could have fewer or more. Correspondingly, circuitry 150 including U1 can be designed such that U1 recognizes any suitable number of states of SW1 (156).

As shown, pins PA0 and PB6 of U1 are used in conjunction with a dynamically-reconfigurable voltage divider including R1, R2, and RLDR (a photoresistor, which is a type of photodetector 154). PB6 is maintained as an input, irrespective of the state of the voltage divider. While PB6 could be an analog-to-digital input, according to techniques described herein, it is a digital input capable of detecting coarsely whether the voltage across RLDR is in a high range or a low range. PA0 is switched between an input state and a logic-high output state depending on how the voltage divider is to be configured.

Figure 5B:
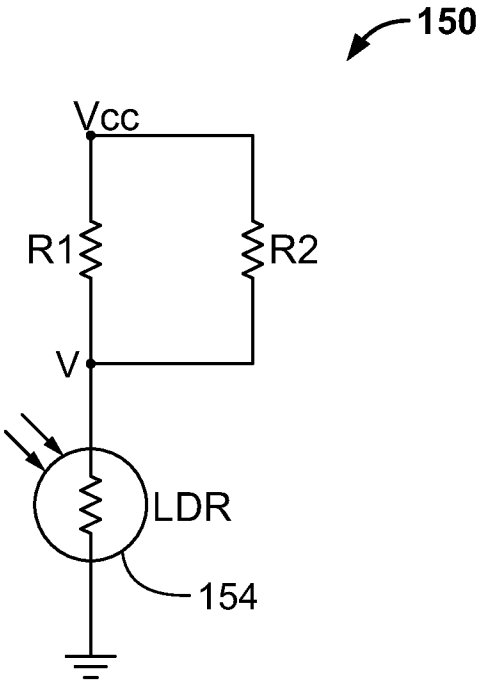
FIGS. 5A and 5B illustrate two configurations of a dynamically-reconfigurable voltage divider for setting different thresholds used during operation of the flameless candle, according to embodiments disclosed herein.
Figure 5A:
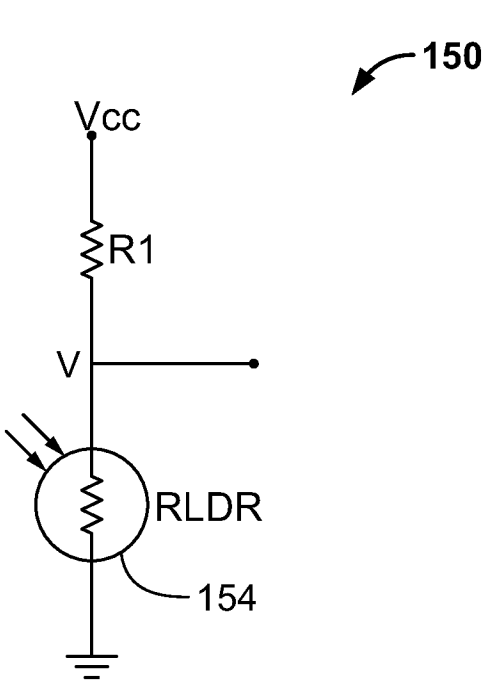

The dynamic configurability of the voltage divider is illustrated in FIGS. 5A and 5B. FIG. 5A shows the effective circuit of the voltage divider when PA0 is configured as an input. In this circuit, a voltage divider is formed with R1 and RLDR, with R1 being the top leg and RLDR being the bottom leg. FIG. 5B shows the effective circuit of the voltage divider when PA0 is configured as a logic-high output. Now, the top leg includes R2, which is in parallel with R1. In the second configuration, the resistance of the top leg will be less than that shown in the first configuration. Therefore, the voltage across RLDR will tend to be higher in the second configuration.

The dynamic configurability of the voltage divider provides hysteresis to the algorithms disclosed herein. In certain modes, the candle 100 detects ambient light levels and turns the light source 158 ON when the detected light is less than a first threshold and turns the light source 158 OFF when the detected light is greater than a second threshold. The first threshold can be lower than the second threshold (e.g., the first threshold can be approximately 50 LUX and the second threshold can be approximately 200 LUX as detected by a photodetector 154 located within the interior region of the candle 100 and associated circuitry).

The reconfigurable voltage divider also allows a digital input pin on U1 to be used to detect the voltage across RLDR (e.g., GL5537-1 photoresistor), rather than an analog-to-digital converter (ADC), although such circuitry still within the scope of techniques described herein. Advantages of using a digital input to detect voltage include reduced cost and measurement speed. As for the latter, an ADC can take a relatively long amount of time to obtain a measurement, such as 1.0 mS. Furthermore, using an ADC consumes additional energy compared to digital inputs. This may not be suitable for certain techniques described herein, such as the technique for reducing optical feedback from light source 158 when detecting the voltage across RLDR, as will be further discussed.

The explanation below is but one exemplary way to implement the reconfigurable voltage divider. As background, with CMOS technology, a digital input detects a logical HIGH when the input voltage is greater than 0.7*VDD, where 1.6 v<VDD<5.5 v. A logic LOW is detected when the input voltage is less than 0.3*VDD. In this particular example, RLDR varies between >3 MΩ in darkness up to 1 kΩ (or greater) when RLDR is exposed to illuminance of 300 lux (or greater). At 10 lux, RLDR is between 20 to 30 kΩ. At 100 lux, RLDR is about 4 kΩ. At 200 lux, RLDR is about 2 kΩ. R1 is 7 kΩ, R2 is 30 kΩ, and VDD is 3 v. The logic HIGH threshold for the digital input pin is 2.1 v. The logic LOW threshold for the digital input pin is 0.9 v.

In the state shown in FIG. 5A (when the LD1 is OFF or the ambient light is sufficiently bright), the voltage V applied to digital input PB6 equals:

$$(VDD*RLDR)/(R1+RLDR), \text{ or } (3*RLDR)/(7{,}000+RLDR)$$

In the state shown in FIG. 5B (when the LED is ON or the ambient light is sufficiently bright), the voltage V equals:

$$(VDD*RLDR)/(1/(1/R1+1/R2)+RLDR), \text{ or } (3*RLDR)/(\sim 5{,}700+RDLR)$$

In a first phase, LD1 is ON and the voltage divider is in the configuration shown in FIG. 5B. The ambient light is dim, and the voltage V remains above the logic HIGH threshold of 2.1 v. LD1 remains ON.

In a second phase, LD1 is still ON and the combination of the ambient light and the LED light rises to between approximately 200 to 300 lux, such that V drops below 0.9 v. The logic LOW threshold is exceeded, and LD1 is turned OFF. At this point, the reconfigurable voltage divider is reconfigured into the state shown in FIG. 5A. This reduces the potential for instability. Consider that when LD1 is turned OFF, the detected luminosity may drop to 100 lux. If the voltage divider remained in the configuration shown in FIG. 5B, the voltage V could increase to above 2.1 v, such that a logic HIGH state would be detected. This could cause the system to turn LD1 ON, thereby causing a drop in voltage and a logic LOW state to be detected, thereby causing LD1 to be turned OFF. This cycle would repeat in an undesirable way. By changing the voltage divider to the configuration of FIG. 5A when a logic LOW state is detected, the voltage V is reduced to 1.1 v, and a logic HIGH state is not present. Then, LD1 remains OFF and the system does not oscillate undesirably.

In a third phase, LD1 is OFF and luminosity drops to less than ~10 lux and the voltage V rises to above 2.1 v. LD1 is then switched ON. The light added by LD1 causes RLDR to decrease. Such a decrease could then cause voltage V to undesirably drop below 0.9 v, thereby causing LD1 to turn OFF. Again, the system would oscillate unstably. By changing the voltage divider to the configuration of FIG. 5B, the decrease in the resistance of RLDR does not lead to a logic LOW being detected. The process then loops back to the first phase and the cycle is repeated.

When determining the voltage across RLDR (or the state of photodetector 154, more generally), it may be useful to reduce or eliminate optical feedback from light source 158. For example, when the light source 158 is ON and the candle 100 is evaluating whether to turn the light source 158 OFF, the circuitry 150 is comparing a detected voltage across RLDR to a threshold. The threshold is based on ambient light levels—i.e., light that is not generated by the light source 158. Photodetector 154, however, can receive light emitted by the light source 158, especially when photodetector 154 is located within the interior region of the candle 100. The addition of light from the light source 158 interferes with evaluating the ambient light levels, since light from the light source 158 is not ambient light.

In order to reduce or eliminate such interference, the light source 158 can be turned OFF momentarily to determine the state of the photodetector (e.g., determine the voltage across RLDR). As discussed, U1 or other circuitry may use a technique such as pulse-width modulation (PWM) to control the apparent intensity of the light source 158. Particularly, the light source 158 may be switched ON and OFF (or switched using HIGH and LOW signals or voltages) rapidly such that the human eye cannot see the individual modulations. Instead, the overall effect is to have a variable intensity of light emitted by the light source 158 according to the duty cycle of the PWM signal. During periods when the PWM signal is OFF or LOW, the state of the photodetector 154 can be determined. Such a period can be relatively quick, such as on the order of 1 mS. Avoiding the use of an ADC may facilitate taking relatively quick measurements of the photodetector 154. By HIGH signal, it should be understood that any voltage sufficient to cause the light source 158 to emit a sufficiently bright light is suitable. By LOW signal, it should be understood that any voltage sufficient to cause the light source 158 to emit a sufficiently dim light (e.g., no light) is suitable. Primarily, the HIGH signal has a higher voltage than the LOW signal.

Figure 6:
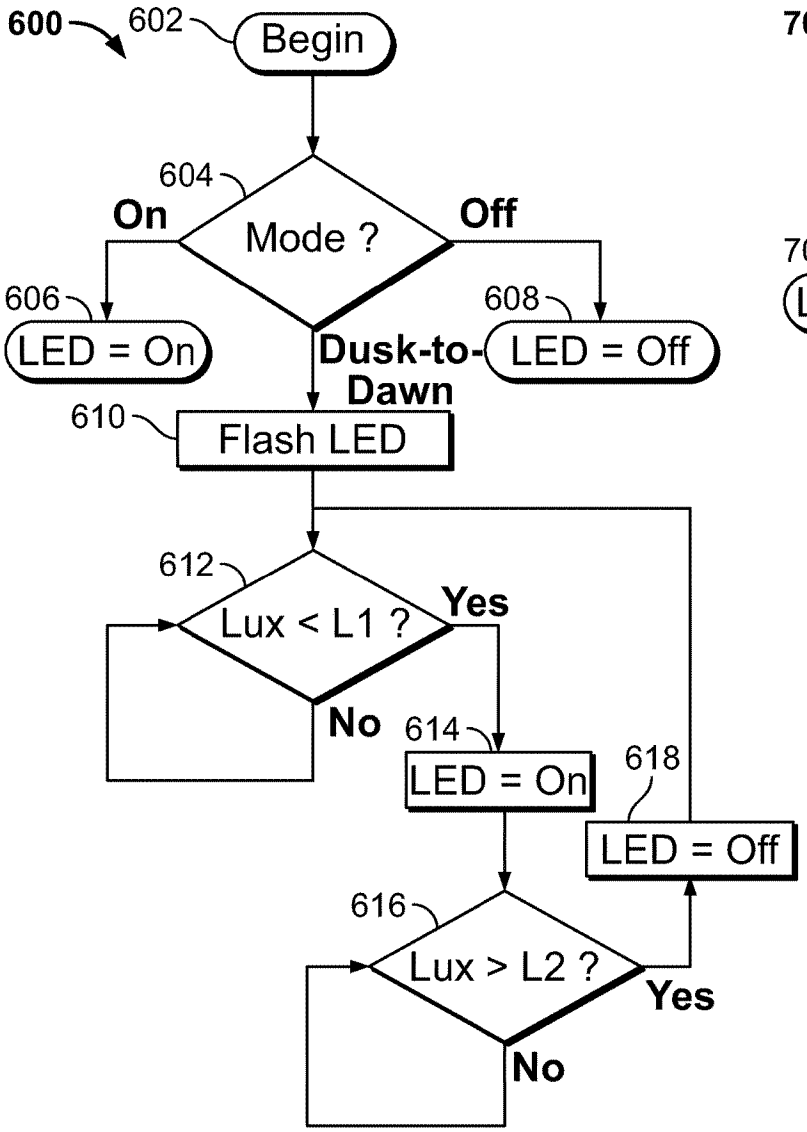
FIG. 6 illustrates a flowchart for a method of operation of a flameless candle, according to embodiments disclosed herein.

FIG. 6 illustrates a flowchart 600 for a method of operation for a flameless candle. The method implements a "dusk-to-dawn" algorithm. For exemplary context (i.e., without limitation), the flowchart 600 will be described with respect to candle 100. Throughout the operation of the method, U1 can be, but need not be, operational. The method can be performed at least in part by a processor (e.g., U1) executing a set of instructions stored in a non-volatile memory, such as flash or ROM. The flowchart 600 is illustrative, and steps can be performed in different orders and/or omitted.

At step 602, the flowchart 600 begins. For example, batteries may be inserted into the candle 100, and U1 begins running. At step 604, U1 determines what mode the candle 100 has been placed in by a user-either through switch 156 or a remote control. The flowchart 600 may return to step 604 whenever a change in mode is detected (e.g., by interrupt processing or by periodically polling inputs). Different possible modes include calling for the LED to be constantly ON, the LED to be constantly OFF, or the LED to be switched in a "dusk-to-dawn" manner. Additional modes can be implemented on candle 100, including the "dusk-plus-timer" mode described in FIG. 7. According to the dusk-to-dawn mode, as will further be explained, the LED is automatically turned ON when the detected ambient light is lower than a first threshold L1, and the LED is automatically turned OFF when the detected ambient light is greater than a second threshold L2.

When the mode calls for the LED to be constantly ON, then the flowchart 600 progresses to step 606, in which the LED is turned ON and maintained in that state until the mode changes. Even though the LED is constantly ON, it may still be switched OFF momentarily during operation such that mimics the behavior a flickering candle flame. Such switching can be through PWM, either implemented by U1 or other circuitry, such as circuitry embedded in the LED. When the mode calls for the LED to be constantly OFF, then the flowchart 600 progresses to step 608, in which the LED is turned OFF and maintained in that state until the mode changes.

When the user input indicates that the dusk-to-dawn mode is selected, the flowchart 600 progresses to step 610, at which the LED is flashed (e.g., flashed once for approximately 0.5 seconds). This provides visual feedback to the user to indicate that the dusk-to-dawn mode has been activated. Afterwards, the flowchart 600 progresses to step 612, where the ambient brightness (Lux) is compared to a first threshold L1. The ambient brightness is sensed by photodetector 154 and evaluated by U1, for example, as described above. The sensed brightness translates to voltage, which is used as a proxy for Lux. Thus, L1 actually corresponds to a voltage. During execution of step 612, the reconfigurable voltage divider can be configured as indicated in FIG. 5A. When the ambient brightness is greater than the first threshold L1, step 612 repeats. The first threshold L1 may correspond to a value selected from 10-50 Lux. For example, the first threshold may correspond to 50 Lux.

When the ambient brightness is less than L1 (at "dusk"), then the flowchart 600 continues to step 614, when the LED is turned ON. Again, the LED can still be periodically switched (for example, to emulate a flickering candle) while considered to be ON.

After the LED is turned ON, the flowchart 600 progresses to step 616, where the ambient brightness is compared to a second threshold L2. The ambient brightness is sensed by photodetector 154 and evaluated by U1, for example, as described above. The sensed brightness translates to voltage, which is used as a proxy for Lux. Thus, L2 actually corresponds to a voltage. During execution of step 616, the reconfigurable voltage divider can be configured as indicated in FIG. 5B. When the ambient brightness is less than the second threshold L2, step 616 repeats. The second threshold L2 may correspond to a value selected from 100-200 Lux. For example, the second threshold may correspond to 200 Lux.

When the ambient brightness is greater than L2 (at "dawn"), then the flowchart 600 continues to step 618, and the LED is turned OFF. The flowchart 600 then progresses to step 612, and the process discussed above is repeated.

Figure 7:
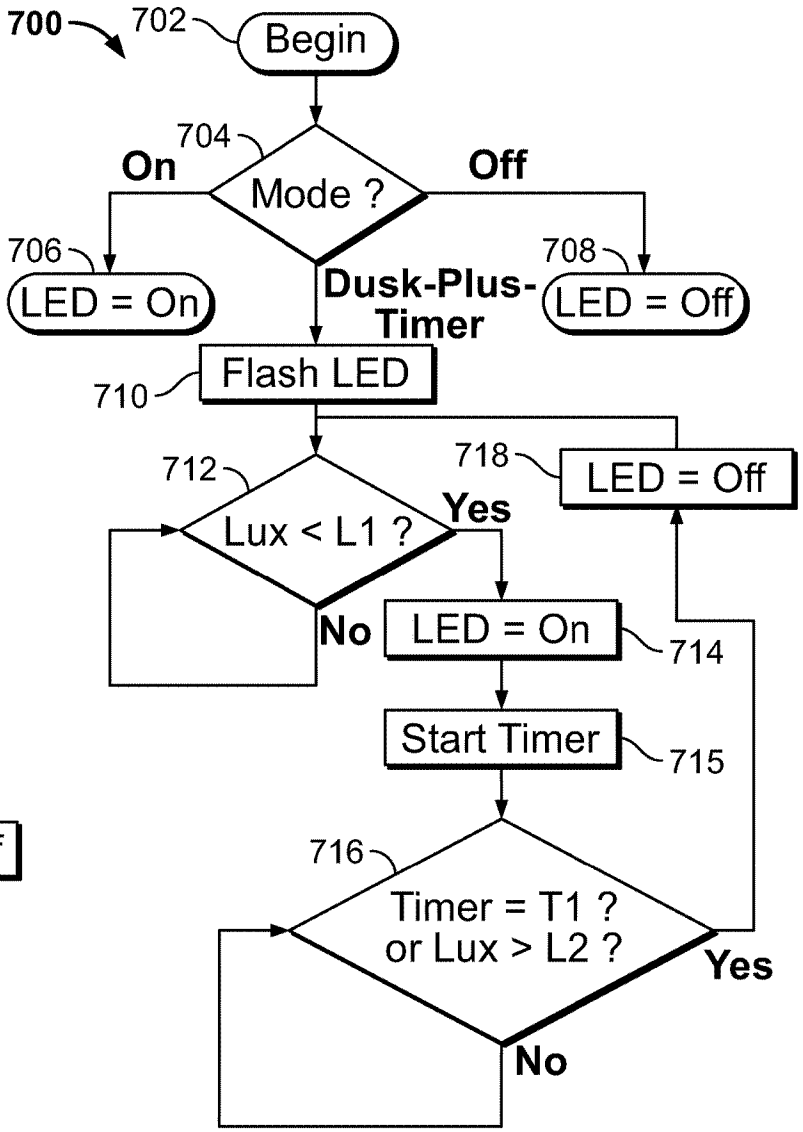
FIG. 7 illustrates a flowchart for a method of operation of a flameless candle, according to embodiments disclosed herein.

FIG. 7 illustrates a flowchart 700 for a method of operation for a flameless candle. The method implements a "dusk-plus-timer" algorithm. This algorithm is similar to the dusk-to-dawn algorithm, except that there is an additional timer that can cause the LED to turn OFF after a predetermined period of time after the LED is first turned ON. Thus, the LED can be turned OFF when the ambient light exceeds a threshold or when the timer runs for a predetermined duration. For exemplary context (i.e., without limitation), the flowchart 700 will be described with respect to candle 100. Throughout the operation of the method, U1 can be, but need not be, operational. The method can be performed at least in part by a processor (e.g., U1) executing a set of instructions stored in a non-volatile memory, such as flash or ROM. The flowchart 700 is illustrative, and steps can be performed in different orders and/or omitted.

At step 702, the flowchart 700 begins. For example, batteries may be inserted into the candle 100, and U1 begins running. At step 704, U1 determines what mode the candle 100 has been placed in by a user—either through switch 156 or a remote control. The flowchart 700 may return to step 704 whenever a change in mode is detected (e.g., by interrupt processing or by periodically polling inputs). Different possible modes include calling for the LED to be constantly ON, the LED to be constantly OFF, or the LED to be switched in a "dusk-plus-timer" manner. Additional modes can be implemented on candle 100, including the "dusk-to-dawn" mode described in FIG. 6, or a mode in which the LED can only be turned OFF after a predetermined duration and the "dawn" aspect of the candle is omitted. According to the dusk-plus-timer mode, as will further be explained, the LED is automatically turned ON when the detected ambient light is lower than a first threshold L1, and the LED is automatically turned OFF if one of two conditions are true. According to the first condition, the timer has run for at least a predetermined period of time T1. According to the second condition, the detected ambient light is greater than a second threshold L2.

When the mode calls for the LED to be constantly ON, then the flowchart 700 progresses to step 706, in which the LED is turned ON and maintained in that state until the mode changes. Even though the LED is constantly ON, it may still be switched OFF momentarily during operation such that mimics the behavior a flickering candle flame. Such switching can be through PWM, either implemented by U1 or other circuitry, such as circuitry embedded in the LED. When the mode calls for the LED to be constantly OFF, then the flowchart 700 progresses to step 708, in which the LED is turned OFF and maintained in that state until the mode changes.

When the user input indicates that the dusk-to-dawn mode is selected, the flowchart 700 progresses to step 710, at which the LED is flashed (e.g., flashed once for approximately 0.5 seconds). This provides visual feedback to the user to indicate that the dusk-plus-timer mode has been activated. Afterwards, the flowchart 700 progresses to step 712, where the ambient brightness (Lux) is compared to a first threshold L1. The ambient brightness is sensed by photodetector 154 and evaluated by U1, for example, as described above. The sensed brightness translates to voltage, which is used as a proxy for Lux. Thus, L1 actually corresponds to a voltage. During execution of step 712, the reconfigurable voltage divider can be configured as indicated in FIG. 5A. When the ambient brightness is greater than the first threshold L1, step 712 repeats. The first threshold L1 may correspond to a value selected from 10-50 Lux. For example, the first threshold may correspond to 50 Lux.

When the ambient brightness is less than L1 (at "dusk"), then the flowchart 700 continues to step 714, when the LED is turned ON. Again, the LED can still be periodically switched (for example, to emulate a flickering candle) while considered to be ON. Subsequently, at step 715, the timer is reset and started. The timer can be a countdown timer or otherwise. According to one technique, the expiration of the timer after a predetermined period of time T1 causes an interrupt and the method proceeds to step 718.

After the LED is turned ON, the flowchart 700 progresses to step 716, where two conditions are evaluated. First, it is determined whether the ambient brightness is compared to a second threshold L2. The ambient brightness is sensed by photodetector 154 and evaluated by U1, for example, as described above. The sensed brightness translates to voltage, which is used as a proxy for Lux. Thus, L2 actually corresponds to a voltage. During execution of step 716, the reconfigurable voltage divider can be configured as indicated in FIG. 5B. The second threshold L2 may correspond to a value selected from 100-200 Lux. For example, the second threshold may correspond to 200 Lux.

Second, it is determined whether the timer has run for a predetermined period of time T1 (or longer). Such a time period can be 5 hours or 6 hours. When the ambient brightness is less than the second threshold L2 and the timer has run for less than T1, step 716 repeats. If either of these conditions are true, the flowchart 700 proceeds to step 718, when the LED is turned OFF. The flowchart 700 then progresses to step 712, and the process discussed above is repeated.

Figure 8:
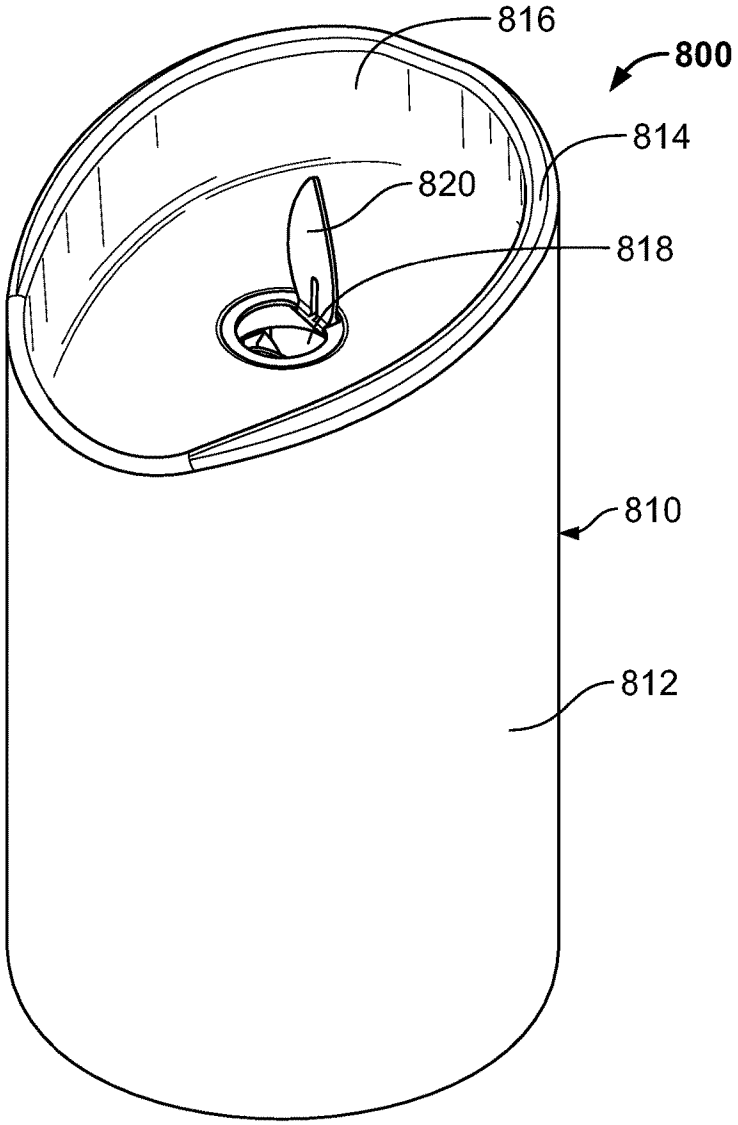
FIG. 8 illustrates a perspective view of a flameless candle, according to embodiments disclosed herein.

FIG. 8 illustrates a candle 800 in a different form while still conforming to the principles discussed herein. The candle 800 is depicted as a pillar candle, but any suitable form is within the scope of the techniques described herein, including taper candles, votive candles, tea lights, irregularly-shaped candles, and the like. As shown, the shell 810 includes a sidewall 812, a rim 814, and an upper surface 816. Some or all of the portions of the shell 810 can include a material such as plastic and/or wax. The sidewall 812 extends upwardly and terminates at the rim 814. The upper surface 816 extends inwardly from the rim 814. The upper surface 816 can form a recess to create the impression of a conventional candle that has been used. The upper surface 816 includes an aperture 818, through which light from a light source (not shown) is emitted. According to some techniques, the photodetector is positioned such that it receives ambient light that is transmitted through the aperture 818. A flame element 820 extends upwardly from the upper surface 816 and receives the light projected by the light source through the aperture 818. According to some techniques, the flame element 820 moves during operation to simulate a real candle flame. According to some techniques, the flame element 820 does not move during operation, and two or more light sources project light onto differing regions of the flame element 820 (distinct or overlapping regions). The light sources are independently controlled to create a sense of motion that emulates a true candle flame. According to some techniques, a moving lens (not shown) is interposed between the light source and the flame element 820. The movement of the lens causes the light projected onto the flame element 820 to vary (change shape and position). While there may be some differences between candle 100 and candle 800, the dusk-to-dawn and dusk-plus-timer principles discussed herein may be similar or identical.

Figure 9:
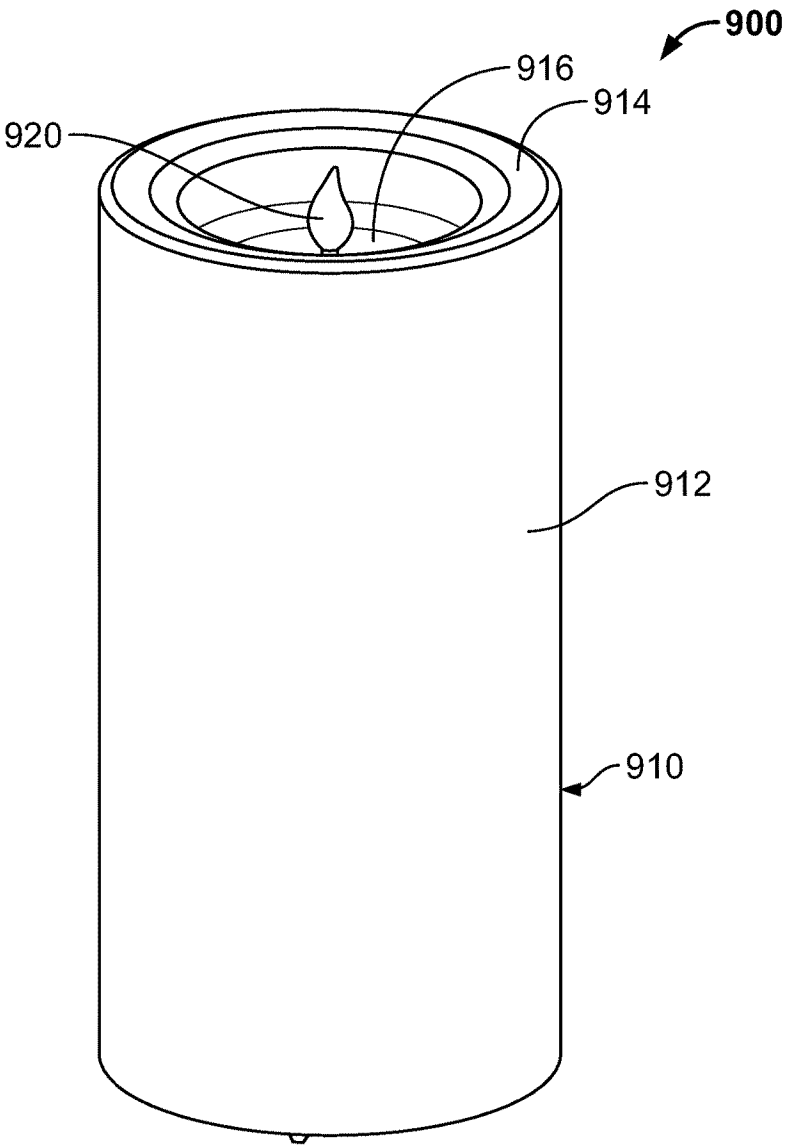
FIG. 9 illustrates a perspective view of a flameless candle, according to embodiments disclosed herein.

FIG. 9 illustrates a candle 900 in a different form while still conforming to the principles discussed herein. The candle 900 is depicted as a pillar candle, but any suitable form is within the scope of the techniques described herein, including taper candles, votive candles, tea lights, irregularly-shaped candles, and the like. As shown, the shell 910 includes a sidewall 912, a rim 914, and an upper surface 916. Some or all of the portions of the shell 910 can include a material such as plastic and/or wax. The sidewall 912 extends upwardly and terminates at the rim 914. The upper surface 916 extends inwardly from the rim 914. The upper surface 916 can form a recess to create the impression of a conventional candle that has been used. A flame element 920 extends upwardly from the upper surface 916. The flame element 920 receives light on its interior surface from a light source located within the candle shell 910. The light source can also be located within the flame element 920. The flame element 920 is translucent, such that light emanates outwardly from the flame element 920.

According to some techniques, the photodetector is positioned within the flame element 920 or directly below the flame element 920. According to some techniques, the flame element 920 moves during operation to simulate a real candle flame. According to some techniques, the flame element 920 does not move during operation, and two or more light sources project light onto differing regions of the flame element 920 (distinct or overlapping regions). The light sources are independently controlled to create a sense of motion that emulates a true candle flame. While there may be some differences between candle 100 and candle 900, the dusk-to-dawn and dusk-plus-timer principles discussed herein may be similar or identical.

It will be understood by those skilled in the art that various changes may be made and equivalents may be substituted without departing from the scope of the novel techniques disclosed in this application. In addition, many modifications may be made to adapt a particular situation or material to the teachings of the novel techniques without departing from its scope. Therefore, it is intended that the novel techniques not be limited to the particular techniques disclosed, but that they will include all techniques falling within the scope of the appended claims.

The invention claimed is:

1. A flameless candle, comprising:

a body including a translucent shell surrounding an interior region;

a light source configured to emit a light to emulate a candle flame;

a photodetector positioned within the interior region and configured to detect light transmitted through the translucent shell;

circuitry configured to detect a state of a user input, detect a voltage across the photodetector, and selectively control the light source based on the state of the user input and the voltage across the photodetector, wherein the user input comprises at least one of a switch or a wireless receiver configured to receive a signal from a remote control, wherein the user input has at least three states, including constantly OFF, constantly ON, and a dusk-based mode state; and wherein the circuitry is configured to:

at any given time, implement only one of (a) keep the light source constantly OFF when the user input is in the OFF state, (b) keep the light source constantly ON when the user input is in the constantly ON state, or (c) implement a dusk-based mode when the user input is in the dusk-based mode state; and when the user input is in the dusk-based mode state, cause operations such that while the light source is OFF, compare the voltage of the photodetector to a first threshold, and when the voltage transitions to less than the first threshold, cause the light source to turn ON, and while the light source is ON, compare the voltage of the photodetector to a second threshold, and when the voltage transitions to greater than the second threshold, cause the light source to turn OFF, wherein the first threshold is less than the second threshold.

2. The flameless candle of claim 1, wherein the photodetector comprises a photoresistor.

3. The flameless candle of claim 2, wherein the circuitry is automatically reconfigured between a first electrical configuration when the light source is OFF and a second electrical configuration when the light source is ON.

4. The flameless candle of claim 3, wherein the photodetector is included in a voltage divider.

5. The flameless candle of claim 4, wherein the configuration of the voltage divider in the first electrical configuration is different than the configuration of the voltage divider in the second electrical configuration.

6. The flameless candle of claim 5, wherein the circuitry includes a processor comprising:

a first pin configured as a digital input in electrical communication with the voltage divider to detect the voltage across the photodetector; and a second pin configured as an input in the first configuration and configured as an output in the second configuration, such that when the second pin is configured as an input, a resistor is removed from the voltage divider, and when the second pin is configured as an output, the resistor is added to the voltage divider.

7. The flameless candle of claim 1, wherein the circuitry is configured to:

apply a low voltage to the light source when the light source is emitting light;

while the voltage is low, detect the voltage across the photodetector; and after detecting the voltage across the photodetector, apply a high voltage to the light source.

8. The flameless candle of claim 1, wherein the user input comprises the switch.

9. The flameless candle of claim 1, wherein the user input comprises the wireless receiver.

10. The flameless candle of claim 1, wherein the light emitted by the light source flickers.

11. The flameless candle of claim 1, wherein the circuitry further comprises a timer configured to cause the light source to turn OFF after a predetermined period of time after the light source is turned ON.

12. A flameless candle, comprising:

a body including a translucent shell surrounding an interior region;

a light source configured to emit a light to emulate a candle flame;

a photodetector positioned within the interior region and configured to detect light transmitted through the translucent shell;

circuitry configured to detect a state of a user input, detect a voltage across the photodetector, and selectively control the light source based on the state of the user input and the voltage across the photodetector, wherein the user input comprises a switch or a wireless receiver configured to receive a signal from a remote control, wherein the user input has at least three states, including constantly OFF, constantly ON, and a dusk-based mode state; and wherein the circuitry is configured to:

at any given time, implement only one of (a) keep the light source constantly OFF when the user input is in the OFF state, (b) keep the light source constantly ON when the user input is in the constantly ON state, or (c) implement a dusk-based mode when the user input is in the dusk-based mode state; and when the user input is in the dusk-based mode state, the circuitry is configured to:

detect a change of state in the user input and responsively control the light source;

while the light source is OFF, compare the voltage of the photodetector to a threshold, and when the voltage is less than the threshold, cause the light source to turn ON; and cause the light source to turn OFF after a predetermined period of time after the light source turns ON.

13. The flameless candle of claim 12, wherein the circuitry is configured to:

apply a low voltage to the light source when the light source is emitting light;

while the voltage is low, detect the voltage across the photodetector; and after detecting the voltage across the photodetector, apply a high voltage to the light source.

14. The flameless candle of claim 12, wherein the photodetector comprises a photoresistor.

15. The flameless candle of claim 12, wherein the user input comprises the switch.

16. The flameless candle of claim 12, wherein the user input comprises the wireless receiver.

17. The flameless candle of claim 12, wherein the light emitted by the light source flickers.

18. The flameless candle of claim 12, wherein the photodetector is positioned within the interior region of the body and configured to detect light transmitted through the body.

19. The flameless candle of claim 12, wherein the circuitry comprises a processor including a digital input, and wherein the voltage across the photodetector is electrically communicated to the digital input.

* * * * *